250-506.1

XR 4,211,928

United Sta[redacted]

Parsons, Jr. et a

[11] 4,211,928

[45] Jul. 8, 1980

[54] LINEAR STORAGE PROJECTOR

[75] Inventors: George W. Parsons, Jr., North Reading; John J. Munro, III, Westford, both of Mass.

[73] Assignee: Technical Operations, Incorporated, Boston, Mass.

[21] Appl. No.: 964,079

[22] Filed: Nov. 27, 1978

[51] Int. Cl.[2] ..... G21F 5/02

[52] U.S. Cl. ..... 250/497; 250/506; 250/514

[58] Field of Search ..... 250/496, 497, 506, 514

[56] References Cited

U.S. PATENT DOCUMENTS 3,721,826 3/1973 Thomas ..... 250/496

*Primary Examiner*—Harold A. Dixon

Attorney, Agent, ... Alfred H. Rosen

[57] ABSTRACT

A storage unit for a quantity of radioactive material in a capsule attached to a leader by which the capsule can be moved, the unit having a straight passage through a body of radiation-shielding material within which the radioactive material can be stored, and a shutter for one end of the passage that is operable between two limits in one of which it closes the passage and in the other of which it locates a hole in register with the passage. A spring-biased tube in the passage fits in a recess around the hole for retaining the shutter in the "open" position, and this tube can be pulled back from the shutter by a fitting attached to the capsule when the capsule is stored, releasing the shutter to return to the first limit. An interlock is provided to prevent accidental opening of the shutter.

10 Claims, 10 Drawing Figures

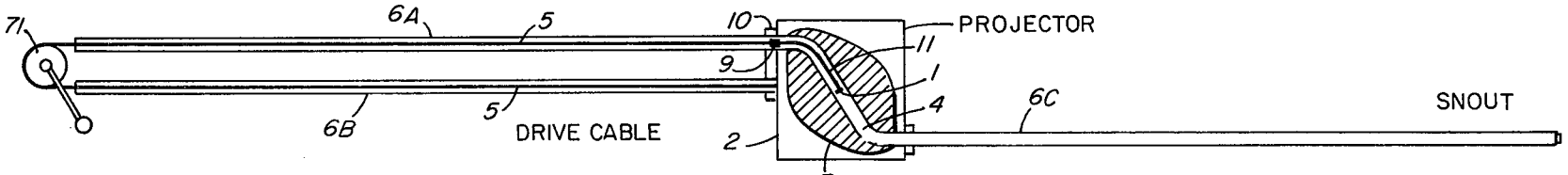
FIG. 1A PRIOR ART STORED POSITION
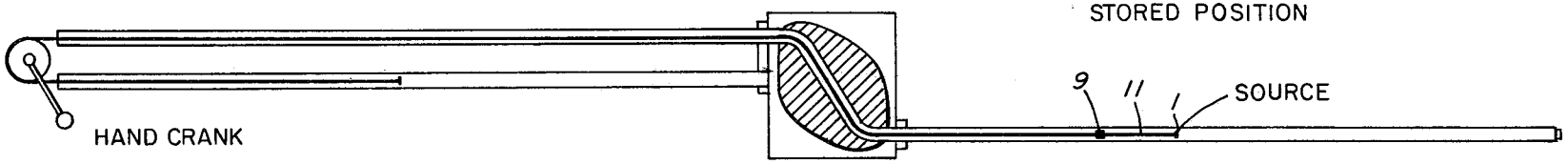
FIG. 1B PRIOR ART SOURCE IN TRANSIT
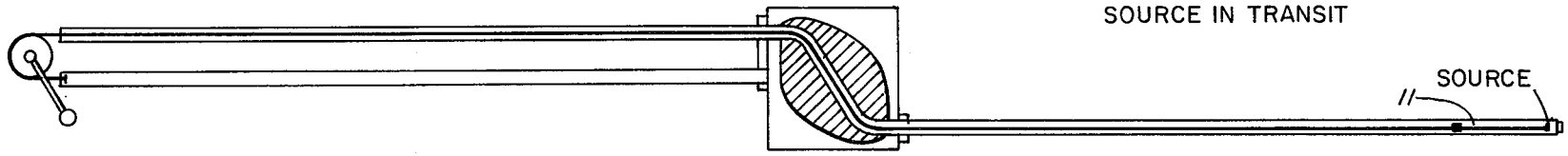
FIG. 1C PRIOR ART SOURCE AT RADIOGRAPHIC SITE
SNOUT (RADIOGRAPHIC FOCAL POINT)
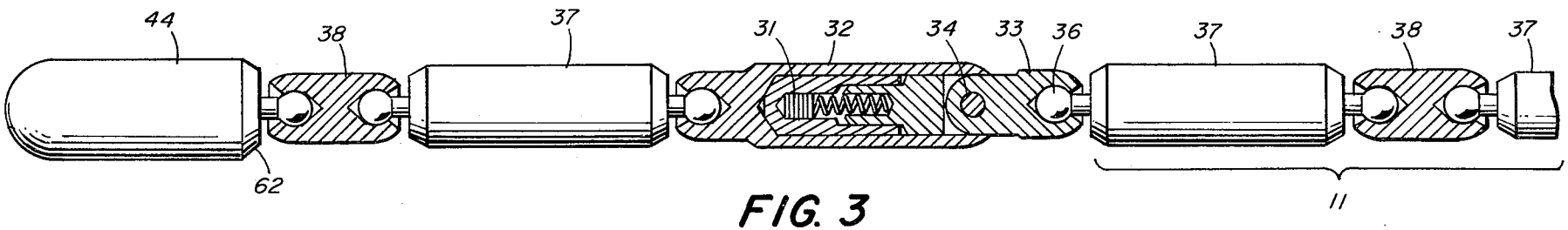
FIG. 3

LINEAR STORAGE PROJECTOR

THE PRIOR ART

As is shown in FIG. 1 of the accompanying drawings, systems for the handling of radioactive material 1 involve the provision of a storage unit 2 having a mass 3 of radiation-shielding material with a passage 4 through it, in which the radioactive material can be safely stored when not in use, as is shown in FIG. 1 at A, and from which the radioactive material can be moved to a use location, as for making a radiograph, as is shown in FIG. 1 at C. Typically, the radioactive material 1 is connected to drive means comprising a flexible cable 5 in a guide tube 6. The guide tube is generally provided in three essentially equal-lengths 6A, 6B and 6C, each of which can be disconnectibly coupled to the storage unit 2. Under control of a reel and crank arrangement 7 the drive cable 5 pushes the radioactive material out of the passage 4 and through the third guide tube 6C to a snout 8 located where the radiograph is to be made, as shown in FIG. 1 at B and C. The portion of drive cable 5 in the second guide tube 6B supplies the cable necessary to fill the first and third guide tubes 6A and 6C when a radiograph is being made. A disconnectible coupler 9 is fitted in the drive cable 5 so that when the radioactive material 1 is in the stored position the drive cable can be parted outside the storage unit for uncoupling the cable 5 and the guide tubes 6A and 6B from the storage unit. The part of drive cable 5 between the coupler 9 and the radioactive material 1 is known as the leader 11, and the coupling apparatus 10 between the guide tubes 6A and 6B and the storage unit 2 generally contains means to lock the leader against movement through the passage 4 when the drive means are uncoupled and removed. U.S. Pat. Nos. 3,147,383 and 3,593,594 describe prior systems in which these features are found.

When the passage 4 through the storage unit is curved as shown in FIG. 1 the mere location of the radioactive material 1 in the middle part of the passage provides storage which shields the region surrounding the storage unit from radiation emitted by the radioactive material. The provision of a curved passage through the mass 3 of radiation-shielding material is, however, more costly than the provision of a straight-through passage, and the conduit which defines the curved passage is subject to wear after the parts holding and guiding the radio-active material have been pushed through it repeatedly.

An early system for exposing a body of radioactive material by moving a rod through a straight passage is described in Gilks U.S. Pat. No. 2,551,491. In the patent a substantial part of the shielding material is moved away from the storage unit, to make the exposure. A form of straight-through exposure system which provides for locating the body of radio-active material remote from the storage unit, under control of a crank-type manipulator as shown in FIG. 1, is illustrated in British Pat. No. 712,009, of Stein; that system, however, uses two separate shielding masses, one rotatable inside the other, in a complex structure, to move the radioactive material from a shielded storage position to a posture in which it can be moved to an exposure position. It also shows a primitive claw-type coupling/decoupling mechanism for the drive cable which does not provide access for manipulating a cable coupling-/decoupling mechanism of the more reliable modern form, as is illustrated, for example, in U.S. Pat. No. 3,237,977. A need exists for a modern system for handling radioactive material which incorporates a storage unit having a straight-through passage in its radiation-shielding mass and is compatible with current requirements of safety, utility, convenience, and lost cost.

GENERAL NATURE OF THE INVENTION

The present invention provides a storage unit for a system of the general type illustrated in FIG. 1 wherein the passage through the radiation shielding material is straight, the storage unit being fittable at a first end with a coupler of modern design for the drive cable and manipulating means, and at the second end with conduit means to guide the radioactive material to a location where a radiograph is to be made. A shutter or cover is provided for the second end, with interlock means to block the second end of the straight passage when the radioactive material is stored in the storage unit. The shutter is mounted on the storage unit for sliding movement transverse to the second end of the passage between first and second limits, the shutter in said first limit blocking the second end, the shutter having a hole through it which registers with the passage when the shutter is in the second limit. Shutter-retaining means are provided within the passage adjacent the second end, and resilient means cooperate with the retaining means and said storage unit for urging the retaining means to project an end-part toward the shutter. Means are provided in the shutter for receiving this end-part when the shutter is in the second limit, and thereby retaining the hole in register with the passage. Means coupled to the capsule are provided for pulling the retaining means away from the shutter against the action of the resilient means under control of the manipulating means, for withdrawing the end-part from the receiving means, and thereby permitting the shutter to move toward the first limit, again blocking the second end.

BRIEF DESCRIPTION OF THE DRAWINGS

FIGS. 1A, 1B and 1C show prior art radioactive source storage systems in different relative positions for storage and use;

FIG. 3 is a partial enlarged view of the leader and radioactive material shown in FIG. 2;

The storage unit 20 shown in FIGS. 2 and 4–8, inclusive, has a mass 23 of radiation-shielding material through which a straight tube 24 provides a straight passage 25. At a first end the tube 24 is fitted with a coupling assembly, generally indicating by reference 30, for manipulating means. This coupling assembly may take any form that is suitable for safety and operational requirements that are current at the time of use; for example, as shown in one of the above-referenced U.S. Pat. Nos. 3,147,383 or 3,593,594. The coupling assembly 30 which is illustrated is described and claimed in a copending joint application of one of the present inventors and another, Ser. No. 964078, filed concurrently with this application, and assigned to the same assignee as the present application. At a second end the tube 24 is fitted with a shutter 40 having a hole 42 through it which can be placed in register with the passage 25. The shutter 40 is movable transverse to the passage 25, between first and second limits. In FIGS. 2 and 5, the shutter is shown in a first limit, blocking the passage. In FIG. 7, the shutter is shown in the second limit, with the hole 42 in register with the passage 25.

Figure 2:
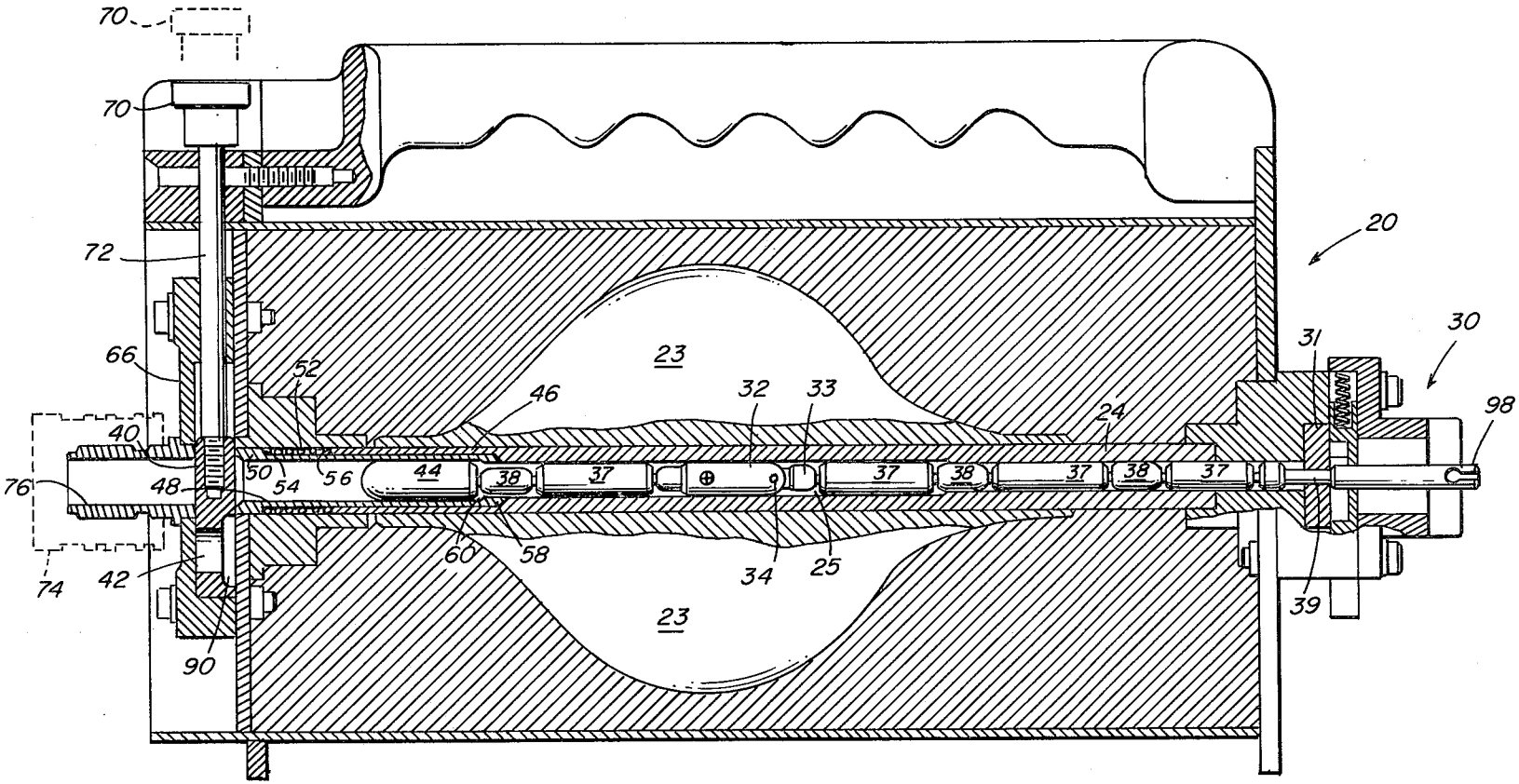
FIG. 2 is a section through a storage unit according to the invention, showing the shutter closed.
Figure 8:
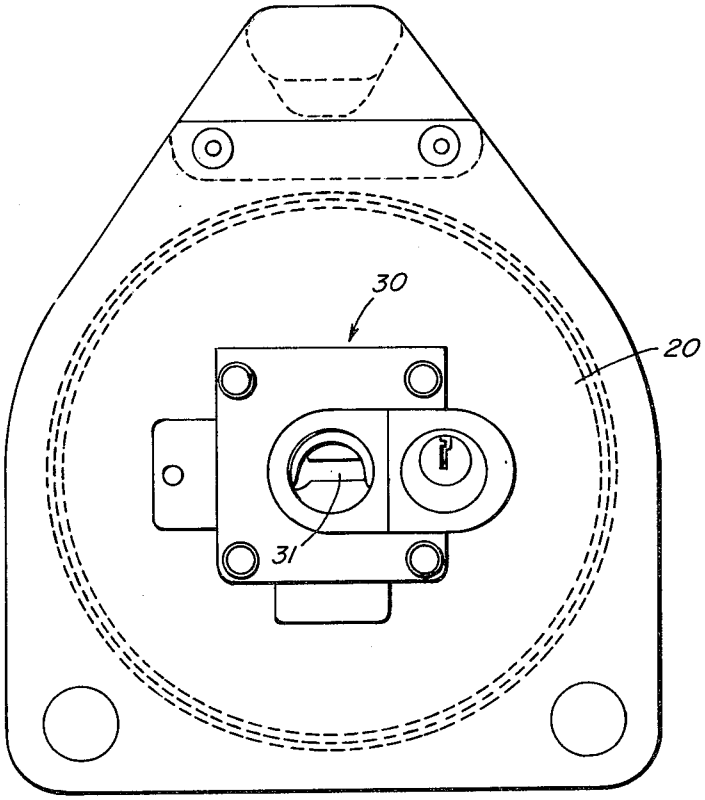
FIG. 8 is an end view of the storage unit from the guide tube and drive-cable coupler end.

Radioactive material 31 (FIG. 3) is housed in a capsule 32 which has a pivotal member 33 connected to it via a pin 34. The capsule is connected by a ball joint 36 to the leader 11, at the other end of which is the female part 98 of the cable connector 9. The leader 11 is made of a chain of cylindrical members 37 of the same diameter all coupled together via ball-joint links 38 having the same diameter. The cable connector has a portion 39 of reduced diameter for locking engagement in the coupling assembly 30 when the radioactive material is to be held in the stored position. The latch portion 39 is locked in a slot (not shown) in a block 31 that is slidably retained in the coupling assembly. Details of the locking mechanism are set forth in the above-identified copending application, and forming no part of the present invention will not be repeated in this specification.

Forward of the leader 11, toward the shutter 40, the capsule 32 is connected via a cylindrical member 37 and ball-joint link 38 to a shutter-control plug 44 having a diameter which is larger than the diameter of the cylindrical members 37. The tube 24 is enlarged internally at a portion 46 adjacent the shutter, and stops short of the shutter. A shutter latch tube 48 fits telescopically within the enlarged portion 46, for slidable motion toward and away from the shutter. The latch tube 48 has a portion at the end 50 confronting the shutter which is enlarged in diameter externally to essentially the same outer diameter as the straight tube 24, and a coil spring 52 surrounds the latch tube between a shoulder 54 on the enlarged end 50 and the confronting end 56 of the straight tube 24.

Figure 4:
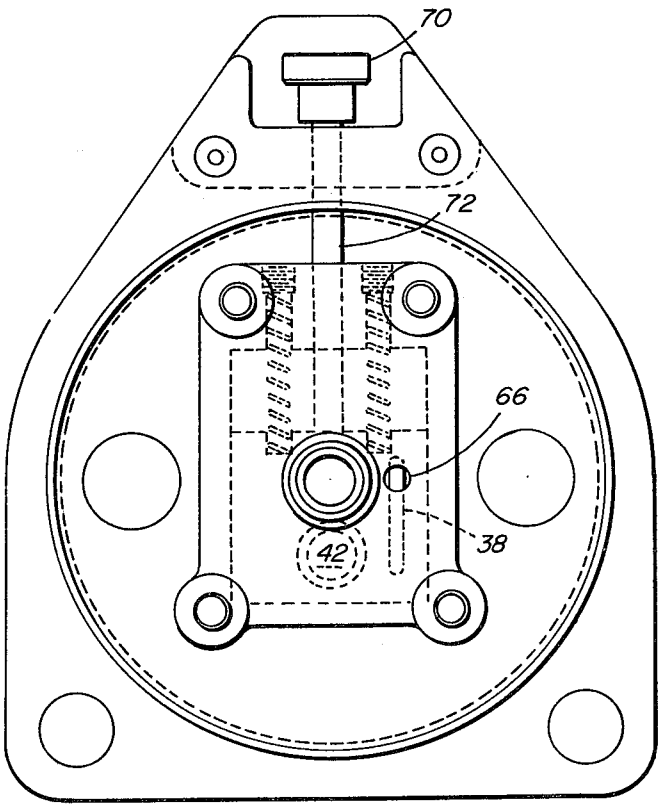
FIG. 4 is an end view of the storage unit from the shutter-end.
Figure 5:
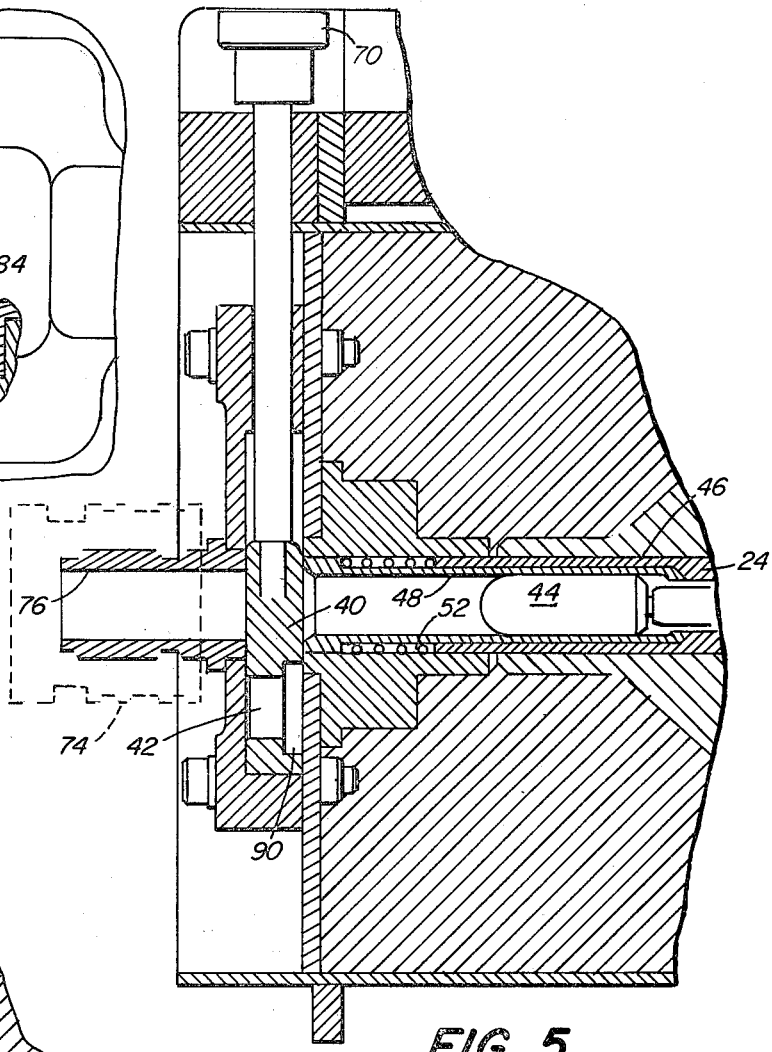
FIG. 5 is an enlarged partial view in section of the shutter end of FIG. 2 with the shutter closed.

At the inner end 58 remote from the shutter 40 the latch tube has a portion of reduced inner diameter providing a shoulder 60 against which the inner end 62 of the shutter control plug 44 can bear. When the radioactive material 31 is returned to the stored position, as by manipulating the crank assembly 7 to withdraw it back from the snout 8, the shutter control plug 44 can be operated to pull the shutter latch tube 48 back from the shutter against the action of the spring 52, by continuing to apply cranking force in the direction of withdrawal. The shutter 40 is slidably mounted in its support 66 and is urged by springs 68 to a position in its first limit, shown in FIGS. 2, 4 and 5. Whenever the latch tube 48 is pulled away from the shutter the shutter 40 is free to take up a position in its first limit.

Figure 6:
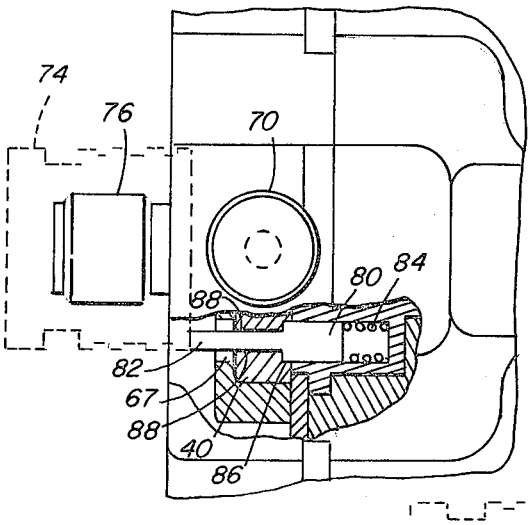
FIG. 6 is a top view, partially in section of FIG. 5.
Figure 7:
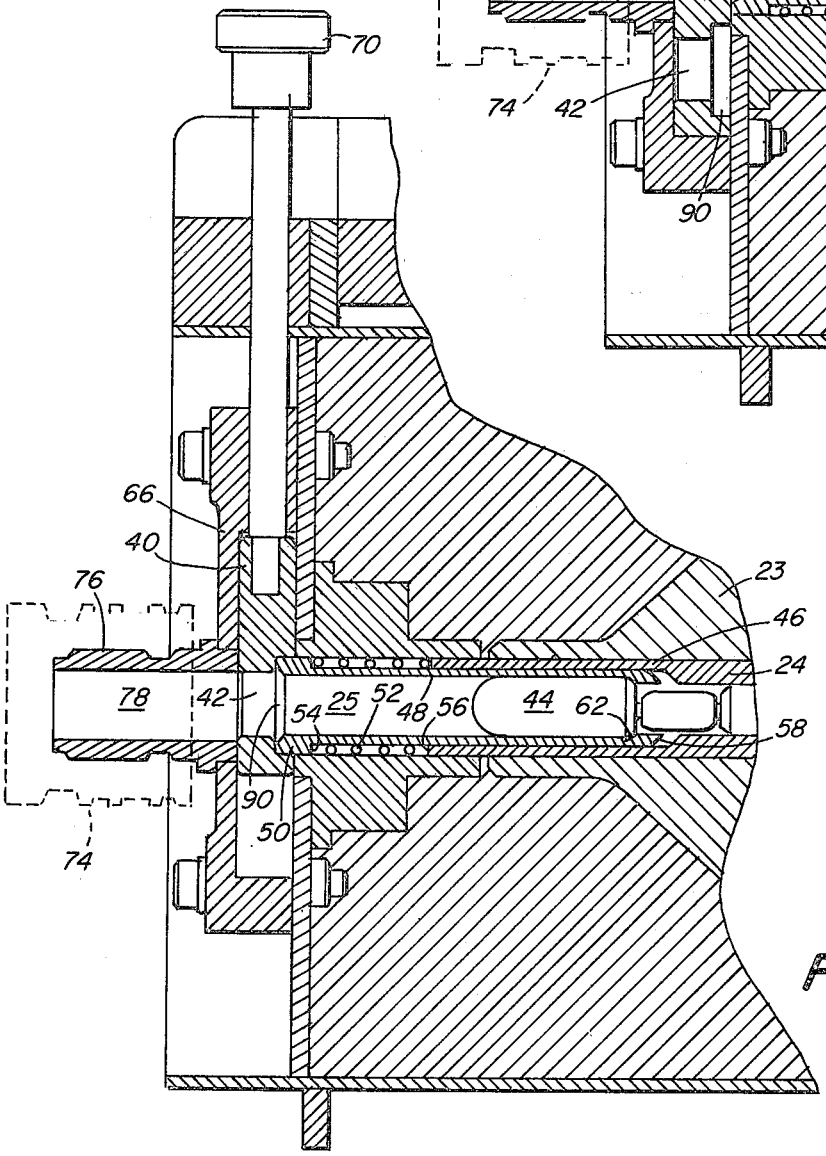
FIG. 7 is a view like FIG. 5 showing the shutter open.

The shutter can be placed in its second limit, shown in FIG. 7, by pulling (upward in the drawings) on the knob 70, which is connected to the shutter by a rod 72. When the shutter is open the knob 70 extends up above the main body of the storage unit, and is shown in dashed line in FIG. 2, acting as a tell-tale. A safety feature is provided for preventing movement of the shutter to the open limit when the guide tube 6C for the snout 8 is not coupled to the storage unit. A connector 74 for that guide tube is represented by dashed lines in FIGS. 2, 5, 6 and 7. This connector couples to a nipple 76 which is a permanent part of the storage unit and is internally bored to provide a continuation 78 of the passage 25. The shutter 40 is fitted with a latch-pin 80 having a stem 82 (shown in FIG. 6) which extends through a hole 67 forward of the shutter housing 66 where it can be pushed by the connector 74 as it is fitted to the nipple 76. The latch pin has a main body that is urged by a spring 84 into a recess 86 in the back wall of the shutter. A slot 88 in the shutter provides a slide-way for the stem 82 when the latch pin is pushed back from the recess 86. When the guide tube 6C is connected, then the shutter 40 can be opened.

When the shutter is opened, by pulling up on the knob after connecting the guide tube coupler 74 to the nipple 76, the hole 42 is moved into register with the passage 25. An annular recess 90 around the hole in the back wall of the shutter has an internal diameter large enough to accept the enlarged end 50 of the shutter latch tube 48. To reduce sliding friction against the back wall of the shutter that end is desirably internally bevelled. The spring 52 urges the latch tube into the recess 90. To avoid permanently compressing the spring 52 with the shutter control member 44 when the capsule 32 is put in the stored position, cranking force at the crank assembly is preferably relaxed after the latch tube 48 has been pulled away from the shutter and the shutter has moved to the closed position, and before the coupler 9 is uncoupled and the leader 11 locked in the coupling assembly 10 of the system. The latch portion 39 of the coupler portion 98 shown in FIG. 2 is long enough to slide in the direction of the passage 25 when the coupler is locked in the coupling assembly 30.

We claim:

1. In radiographic apparatus for manipulating a quantity of radioactive material between a stored position and a use position including a capsule of said radioactive material, a storage unit with means defining a passage through it, for storing the capsule in the passage and shielding the surrounding environment from the stored radioactive material, and manipulating means connectible to said storage unit at a first end of said passage for moving said capsule between a stored position within the passage and a use position outside the second end of said passage, the improvement comprising: a shutter mounted on said storage unit for sliding movement transverse to the second end of said passage between first and second limits, said shutter in said first limit blocking said second end, said shutter having a hole through it which registers with said passage when the shutter is in said second limit, shutter-retaining means associated with said passage means adjacent said second end and resilient means cooperating with said retaining means and said storage unit for urging said retaining means to project an end-part toward said shutter, means in said shutter for receiving said end-part when said shutter is in said second limit and thereby retaining said hole in register with said passage, and means coupled to said capsule for pulling said retaining means away from said shutter against the action of said resilient means under control of said manipulating means for withdrawing said end-part from said receiving means and thereby permitting said shutter to move toward said first limit.

2. Apparatus according to claim 1 including operator means to move said shutter from said first limit to said second limit, said operator means including a tell-tale to indicate visually that said shutter is in one or the other of said limits.

3. Apparatus according to claim 1 wherein said hole is sized to permit said capsule to pass to a use position outside of said storage unit.

4. Apparatus according to claim 1 wherein said shutter retaining means is a tubular member fitted telescopically within said passage means, said resilient means cooperates with said tubular member and said passage means to project an end-part of said tubular member toward said shutter, and said receiving means is an annular recess surrounding said hole, said tubular member having an internal diameter substantially the same as the diameter of said hole.

5. Apparatus according to claim 4 wherein said tubular member has an external flange at said end-part and an internal flange at its other end, said resilient means comprises a coil spring surrounding said tubular member and exerting force on said external flange, and a plug within said tubular member is coupled to said capsule for cooperating with said internal flange for withdrawing said end-part from said annular recess.

6. Apparatus according to claim 1 including resilient means for urging said shutter toward said first limit.

7. Apparatus according to claim 1 including latch means for retaining said shutter in said first limit, and means to release said latch means to free said shutter to be moved toward said second limit.

8. Apparatus according to claim 7 wherein said release means comprises an element extending forward of said storage unit from said second end of said passage.

9. Apparatus according to claim 1 including a nipple fitted to said storage unit at said second end of said passage, for receiving a coupling element of guide tube means for said capsule, latch means for retaining said shutter in said first limit, and means operable by said coupling element upon attachment to said nipple to release said latch means to free said shutter to be moved to said second limit.

10. Apparatus according to claim 9 wherein said release means comprises an element extending forward of said storage unit from said second end of said passage into a position adjacent said nipple, for interaction with said coupling element.

* * * * *